US008695941B1

(12) United States Patent
Groves

(10) Patent No.: US 8,695,941 B1
(45) Date of Patent: Apr. 15, 2014

(54) MULTI STAGE ELECTROMAGNETIC JACK ASSEMBLY

(76) Inventor: Oliver James Groves, Freeland, WA (US)

( * ) Notice: Subject to any disclaimer, the term of this patent is extended or adjusted under 35 U.S.C. 154(b) by 0 days.

(21) Appl. No.: 13/354,326

(22) Filed: Jan. 19, 2012

(51) Int. Cl.

| | |
|---|---|
| ***B66F 13/00*** | (2006.01) |
| ***B66F 3/10*** | (2006.01) |
| ***B66F 3/18*** | (2006.01) |
| ***F01B 7/20*** | (2006.01) |
| *B66F 3/00* | (2006.01) |

(52) U.S. Cl.
USPC ..... 254/1; 254/102; 254/103; 92/53

(58) Field of Classification Search
USPC ..... 254/1, 102, 103, 35, 8 B, 93 R, 53, 2 R, 254/93 H, 100; 92/53
See application file for complete search history.

(56) References Cited

U.S. PATENT DOCUMENTS

| | | | | | |
|---|---|---|---|---|---|
| 1,593,217 | A | * | 7/1926 | Lucker | 254/102 |
| 1,777,599 | A | * | 10/1930 | Bate | 254/102 |
| 1,829,662 | A | * | 10/1931 | Krenzke | 254/102 |
| 1,928,533 | A | * | 9/1933 | Goss | 92/53 |
| 2,050,690 | A | * | 8/1936 | Connell | 254/423 |
| 2,087,718 | A | * | 7/1937 | Bowman et al. | 92/132 |
| 2,803,224 | A | * | 8/1957 | Wilson | 92/53 |
| 3,267,818 | A | * | 8/1966 | Chambers | 92/17 |
| 3,279,755 | A | * | 10/1966 | Notenboom et al. | 254/93 R |
| 3,743,248 | A | * | 7/1973 | Moor | 254/93 R |
| 3,829,063 | A | * | 8/1974 | Holzworth | 254/2 R |
| 3,948,106 | A | * | 4/1976 | Armbruster | 73/457 |
| 4,099,707 | A | * | 7/1978 | Anderson | 254/35 |
| 4,434,968 | A | * | 3/1984 | Smith | 254/1 |
| 4,678,164 | A | * | 7/1987 | Yang | 254/93 H |
| 5,444,348 | A | * | 8/1995 | Garrec | 318/640 |
| 5,664,762 | A | * | 9/1997 | Rothbauer | 254/103 |
| 5,855,360 | A | * | 1/1999 | Wurdack | 254/100 |
| 5,904,340 | A | * | 5/1999 | Allamon | 254/93 H |
| 6,305,667 | B1 | * | 10/2001 | Heller | 254/93 R |
| 6,485,247 | B1 | * | 11/2002 | Groves et al. | 414/589 |
| 6,843,487 | B1 | * | 1/2005 | Lotman | 280/43 |
| 7,464,914 | B2 | * | 12/2008 | Arzouman | 254/8 B |
| 8,360,396 | B2 | * | 1/2013 | Robledo | 254/25 |
| 2002/0185636 | A1 | * | 12/2002 | Salomon | 254/1 |
| 2003/0178809 | A1 | * | 9/2003 | Anderson | 280/477 |
| 2009/0090895 | A1 | * | 4/2009 | Hogan, Jr. | 254/266 |

* cited by examiner

*Primary Examiner* — Alvin Grant

(57) ABSTRACT

An electromagnetic jack assembly. The jack has a first inner jack member having vertical walls, configured to slide within the base, the first inner jack member being nested within the base and having at least two walls connected to respective inside faces of the vertical walls of the base; a first linear magnetic drive assembly, comprising: a magnetic coil; and a magnet track, mounted on the base and the magnetic coil mounted on the first inner jack member or vice versa. The magnetic drive assembly forms the connection between the base and the first inner track. A second inner jack member nested within the first inner jack member and has a second linear magnetic drive assembly. The magnetic drive assembly forms the connection between the first and second inner track members.

7 Claims, 11 Drawing Sheets

MULTI STAGE ELECTROMAGNETIC JACK ASSEMBLY

TECHNICAL FIELD

The present invention, in some embodiments thereof, relates to jacks.

BACKGROUND OF THE INVENTION

The present invention addresses the need for a jack capable of lifting weights and/or be used as a press lifting between (0-40 thousand pounds) with a high degree of accuracy in positioning. (Each inside surface of the jack housing can encompass a coil assembly which will increase the lifting capacity by a factor of 4. However, the electric controls for each of the coil assemblies need to be synchronized.)

BRIEF SUMMARY OF EMBODIMENTS OF THE INVENTION

According to one embodiment of the invention, an telescopic jack comprises: a base having vertical side walls having inside faces with a pair of parallel opposite faces; a first inner jack member having vertical walls, configured to slide within the base, the first inner jack member being nested within the base and having at least two walls connected to respective inside faces of the vertical walls of the base; a first linear magnetic drive assembly, comprising: a magnetic coil; and a magnet track, mounted on the base and the magnetic coil mounted on the first inner jack member or vice versa. The magnetic track has a mechanical locking mechanism configured to prevent retraction of the drive assembly when the track reaches a predetermined extension. The magnetic drive assembly forms the connection between the base and the first inner track. A second inner jack member has vertical walls, and is configured to slide within the first inner jack member. The second inner jack member is nested within the first inner jack member and has at least two walls connected to respective inside faces of the vertical walls of the first inner jack member. A second linear magnetic drive assembly comprises: a magnetic coil; a magnet track, mounted on the first inner jack member and the magnetic coil mounted on the second inner jack member or vice versa. The magnetic track has a mechanical locking mechanism configured to prevent retraction of the drive assembly when the track reaches a predetermined extension. The magnetic drive assembly forms the connection between the first and second inner track members.

In a variant of the telescopic jack, the jack has a plurality of stages, each comprising progressively smaller inner jack members connected to other jack members which encompass them, via a linear magnetic drive assembly.

In another variant, the jack assembly has an outside structure having structural sides and an inside structure having structural sides. The structures are oriented in parallel and in close proximity wherein the outside and inside structures support slide assemblies comprising: rails attached to the structures; a magnetic track; and a coil. A movement system is associated with the slide assemblies with attached rails and coil.

In a further variant, the jack assembly comprises a plurality of telescoping stages, each stage having rail and slide assemblies and a magnetic drive and coil. The jack assembly is adjustable to a desired height via the rail and slide assemblies and magnetic drive and coil at each stage.

In still another variant, the jack is connectable to an overhead structure relative to the ground.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications, and other publications referred to herein, are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
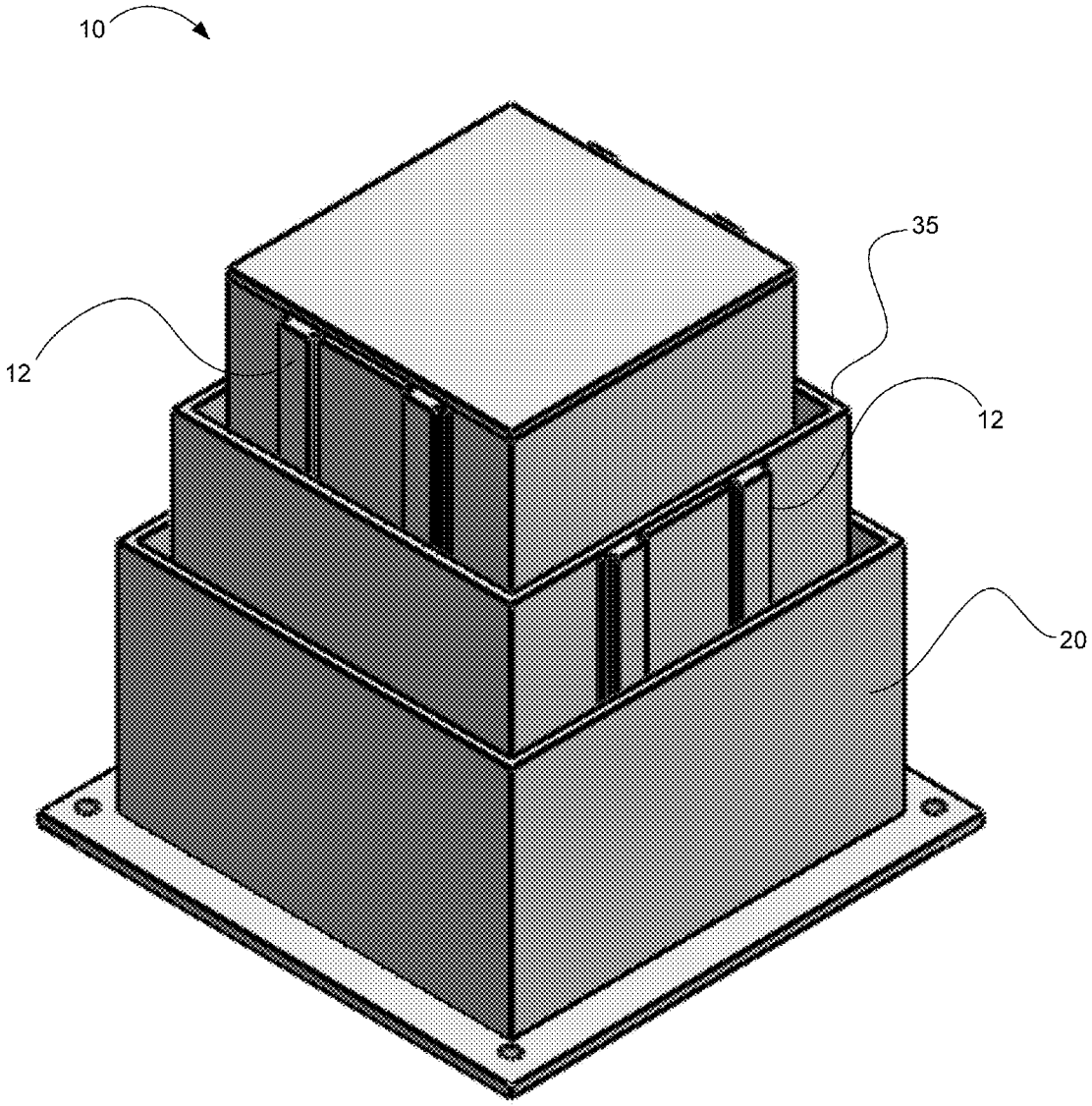
FIG. 1 is a perspective view of a preferred two stage telescopic jack assembly in accordance with the principles of the invention.
Figure 2:
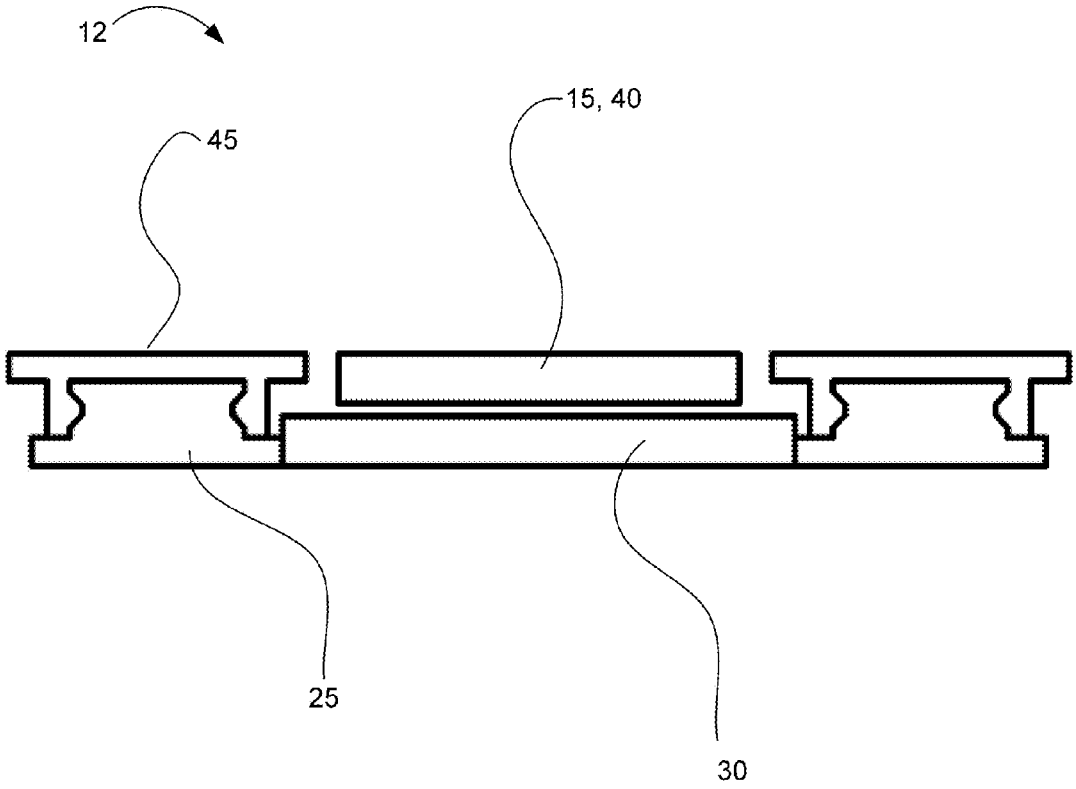
FIG. 2 is a plan view of a magnetic coil assembly.
Figure 3:
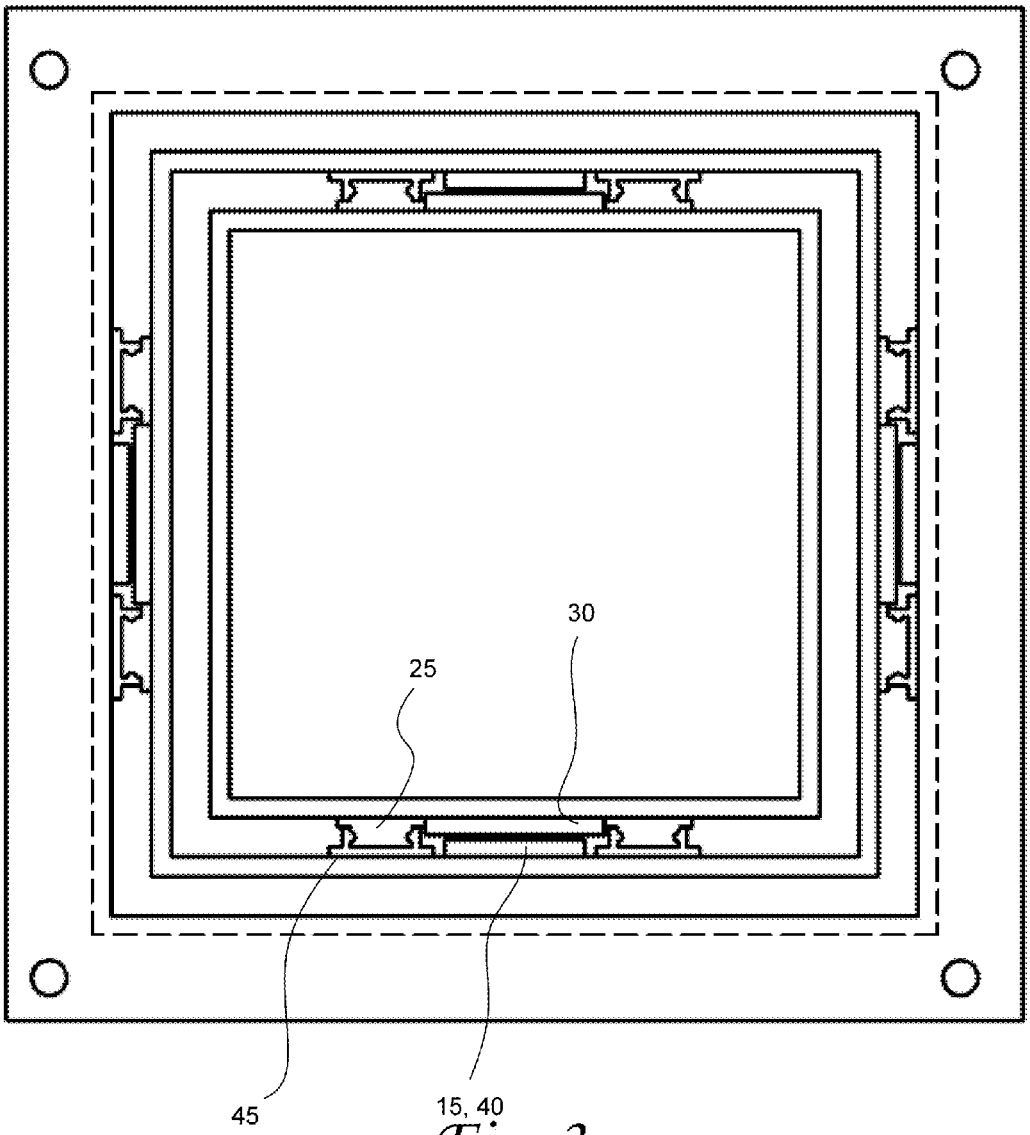
FIG. 3 is a plan view of a two stage telescopic jack assembly.
Figure 4:
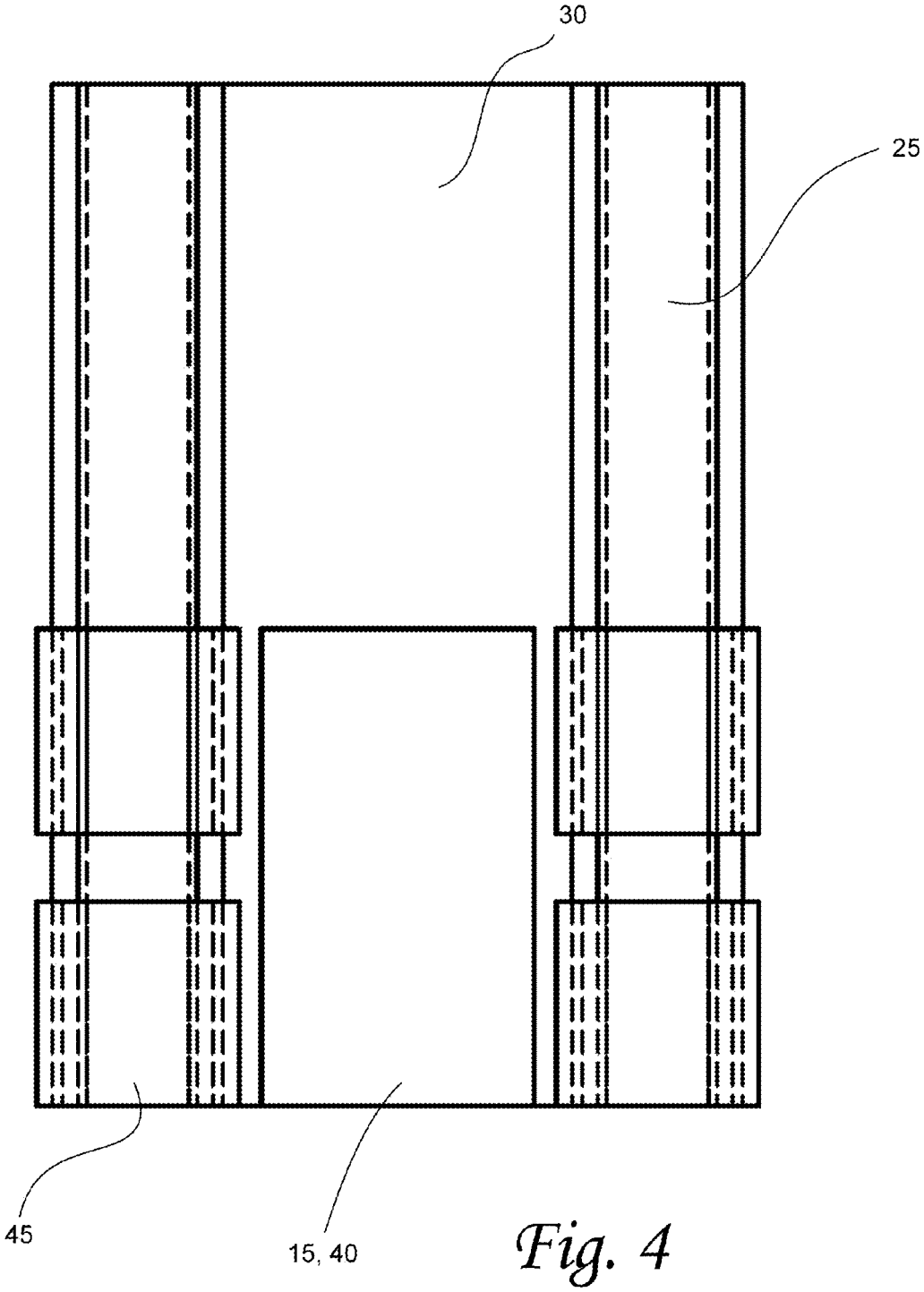
FIG. 4 is a front view of a magnetic coil assembly.
Figure 5:
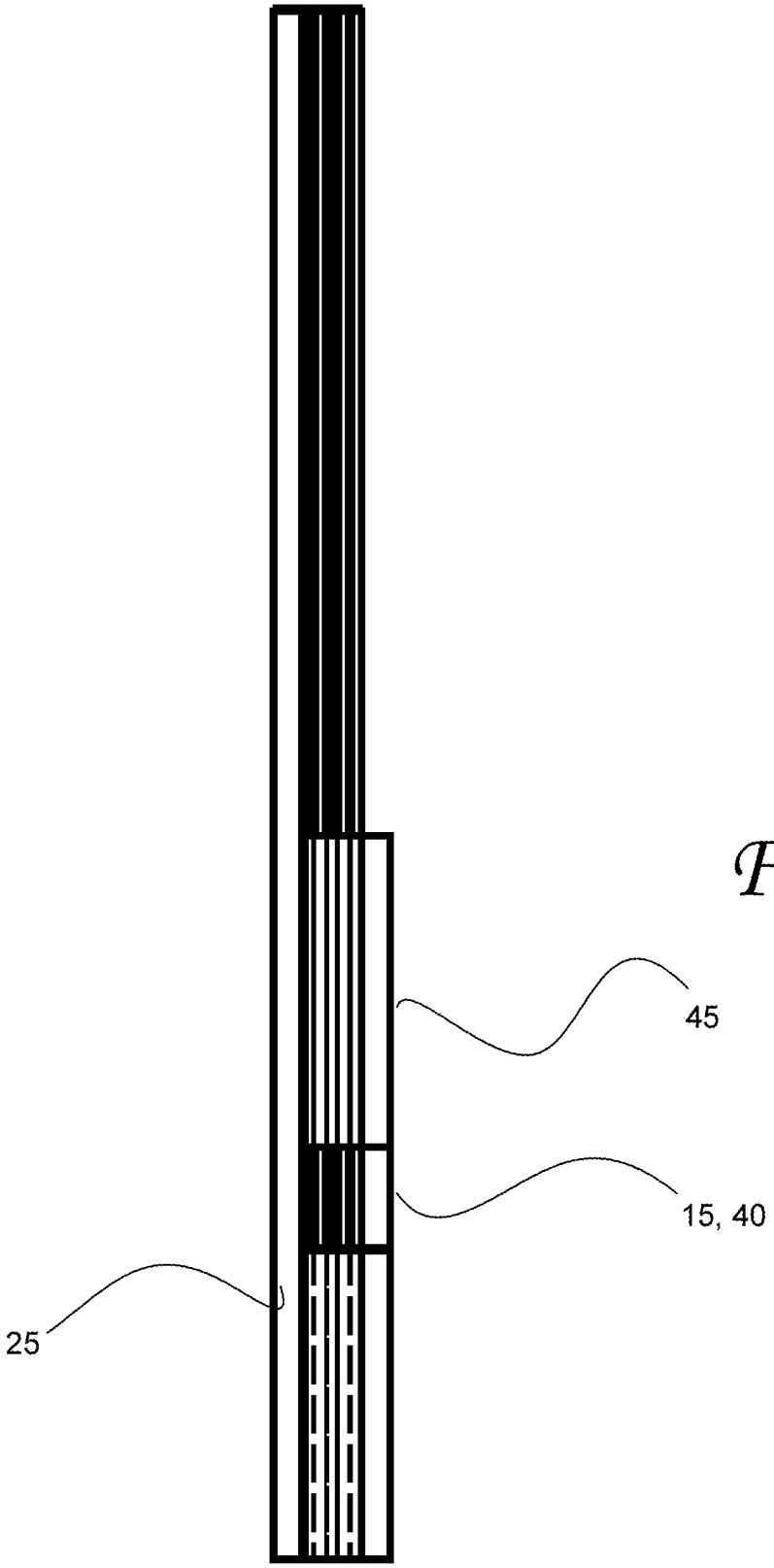
FIG. 5 is a side view of a magnetic coil assembly.
Figure 6:
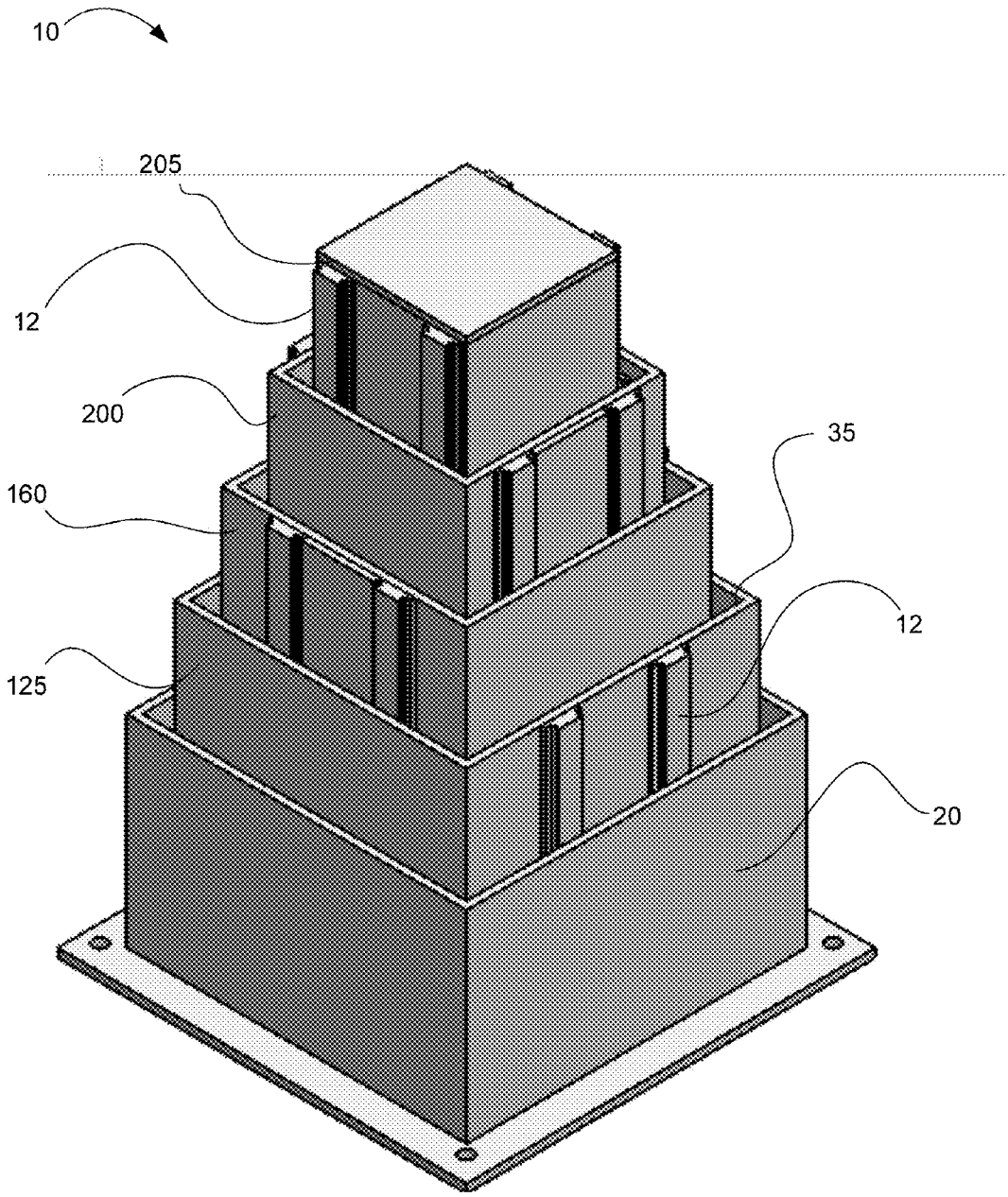
FIG. 6 is a perspective view of a four stage telescopic jack assembly.
Figure 7:
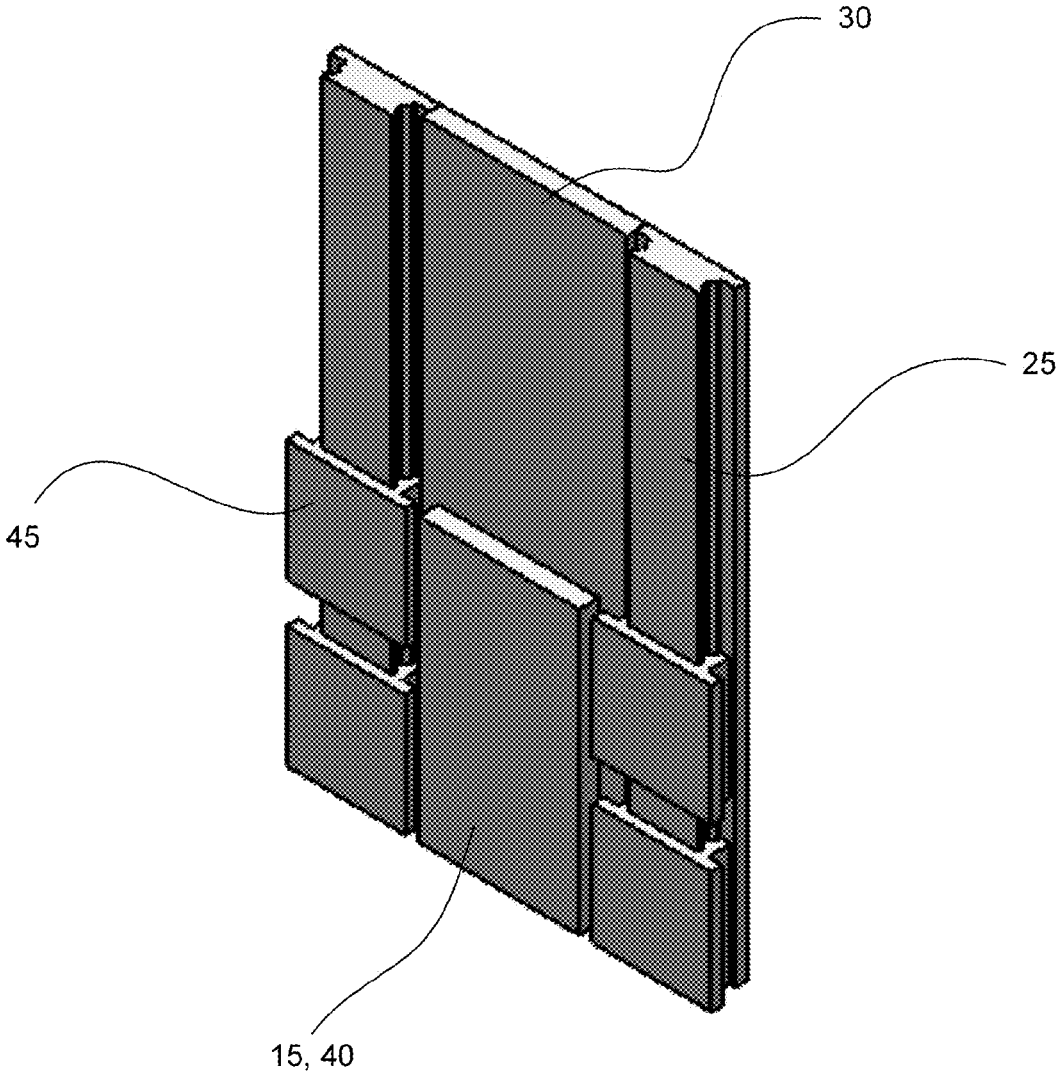
FIG. 7 is a perspective view of a magnetic coil assembly.
Figure 8:
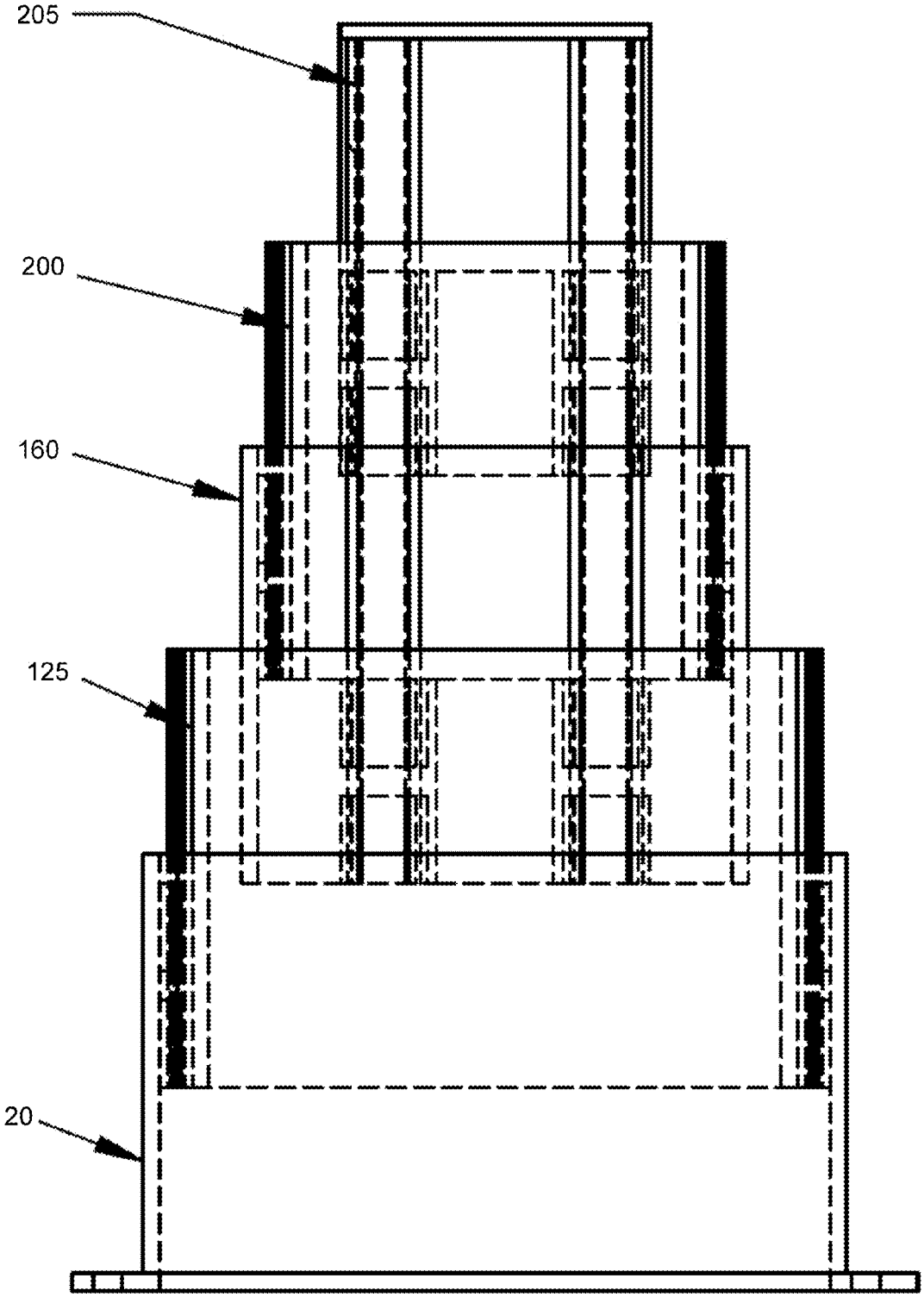
FIG. 8 is a side view of a four stage telescopic jack assembly.
Figure 9:
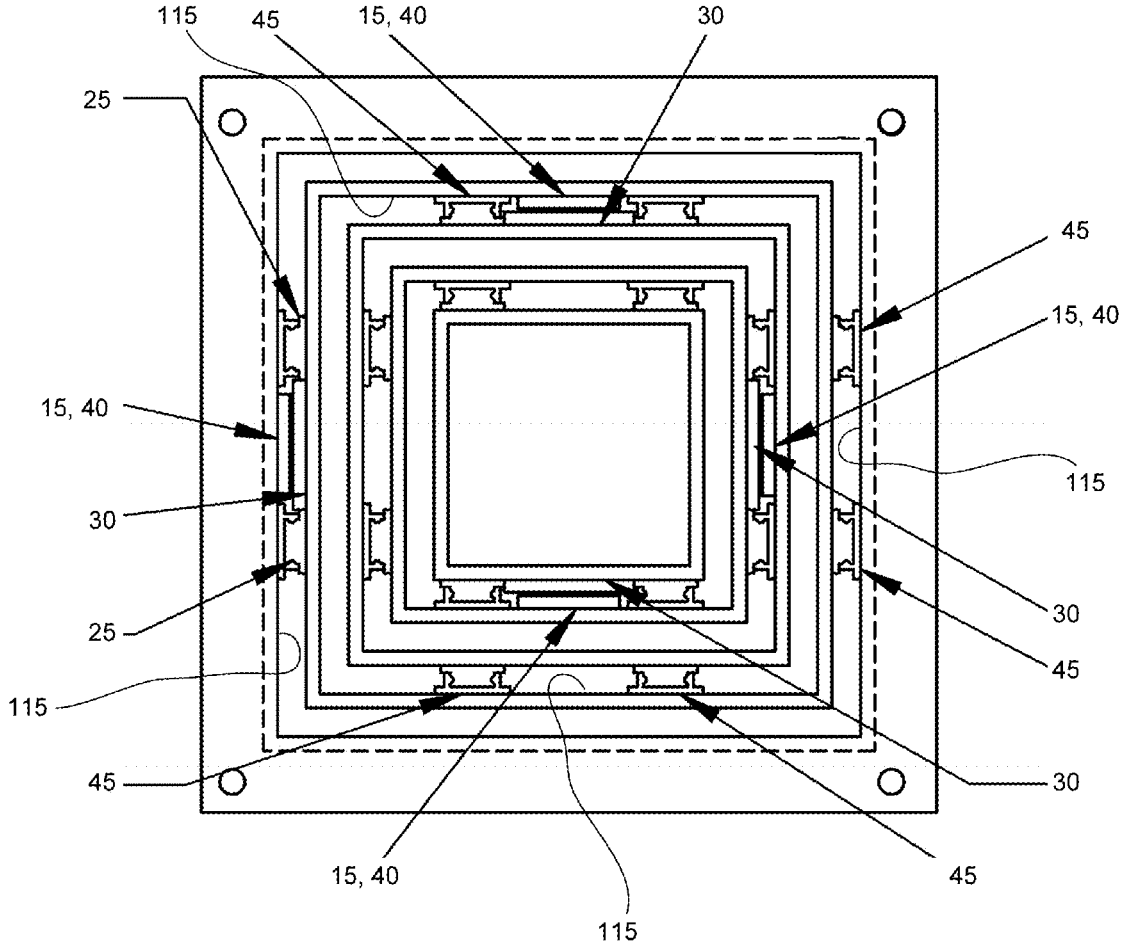
FIG. 9 is a plan view of a four stage telescopic jack assembly.

The present invention, in some embodiments thereof, relates to a magnetic jack assembly 10. In a variant, referring to FIG. 1, a magnetic coil assembly 12 comprises a linear motor 15 vertically mounted on a first frame 20 having sides, and on a magnet track 40 and a coil 30 mounted to a second frame 35 positioned 0.038 mm or 0.015 inches apart from each other 30, 40. The magnetic track travels the length of the coil on THK slides 45 and rails 25 which is determined by the chosen stroke, based on the desired height of the jack in its extended configuration. The jack comprises a minimum of one assembly or more depending on the load expected to be carried. The magnetic coil assemblies 12 comprise the coil 30 mounted to the inside of the structure and controlled by an electromagnetic pulse (Electric Controls) driving the magnetic track 40 that is attached to the structure being lifted. The magnetic track 40 and slides 45 are combined into one ridged unit and the coil 30 and rails are combined into another ridged unit which when assembled together provide the required gap between both units.

The magnetic coil assemblies 12 can be located on each of the sides which are mounted to the base. In one example magnetic jack assembly, one slide assembly is provided with a magnetic attraction force (Magnetic to Coil) of 45,000 Newton's (10,125 pounds). This is the clamping force between the magnetic and coil.

In the first stage 125 of the jack assembly, which is similar to all stages, power is only needed when a load is being lifted. When the first extension of the telescopic jack is fully extended, the first 20 and second frames 35 mechanically lock in place, and power may be transferred to the second stage which travels to its configured height and a third frame 50 locks in place and so forth with subsequent stages. The last stage may not need to be extended fully and a locking mechanism may be provided in the last stage. For holding and positioning the desired height of the jack, a sealed absolute linear encoder may be provided on opposite sides of the frame 20. Accuracies within 5 microns may be obtained.

Figure 10:
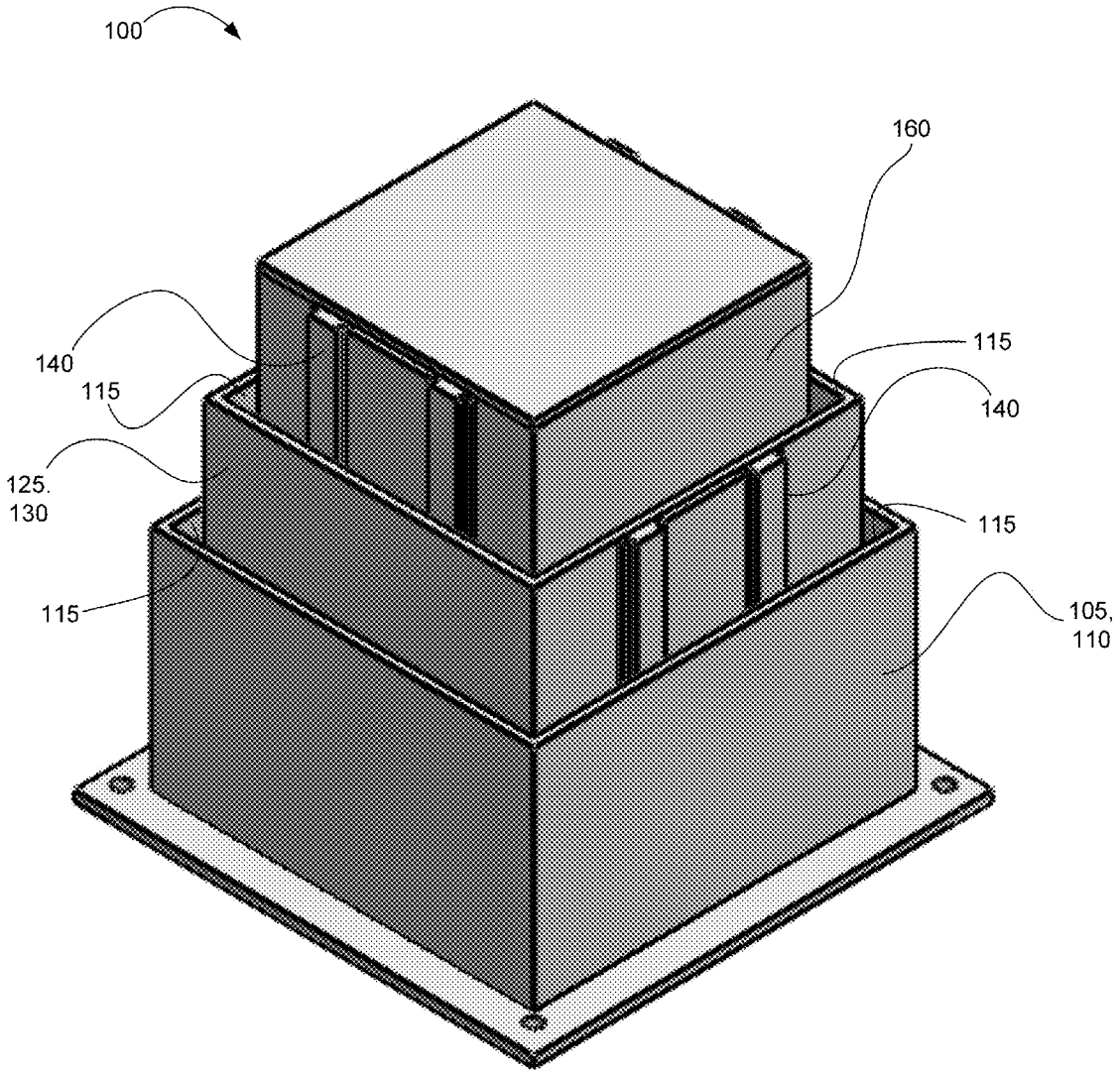
FIG. 10 is a plan view of a two stage telescopic jack assembly.

In a variant, referring to FIG. 10, a telescopic jack 100 comprises a base 105 having vertical side walls 110 having inside faces 115 with a pair of parallel opposite faces 115. A first inner jack member 125 has vertical walls 130 configured to slide within the base 105. The first inner jack member 125 is nested within the base 105 and has at least two walls 135 connected to respective inside faces 115 of the vertical walls of the base.

The jack 100 has a first linear magnetic drive assembly 140. The drive assembly 140 comprises a magnetic coil 150 and a magnet track 145. The magnet track 145 is mounted on the base and the magnetic coil mounted on the first inner jack member or vice versa. The magnetic track has a mechanical locking mechanism 155 configured to prevent retraction of the drive assembly when the track reaches a predetermined extension. The magnetic drive assembly forms the connection between the base and the first inner track.

Figure 11:
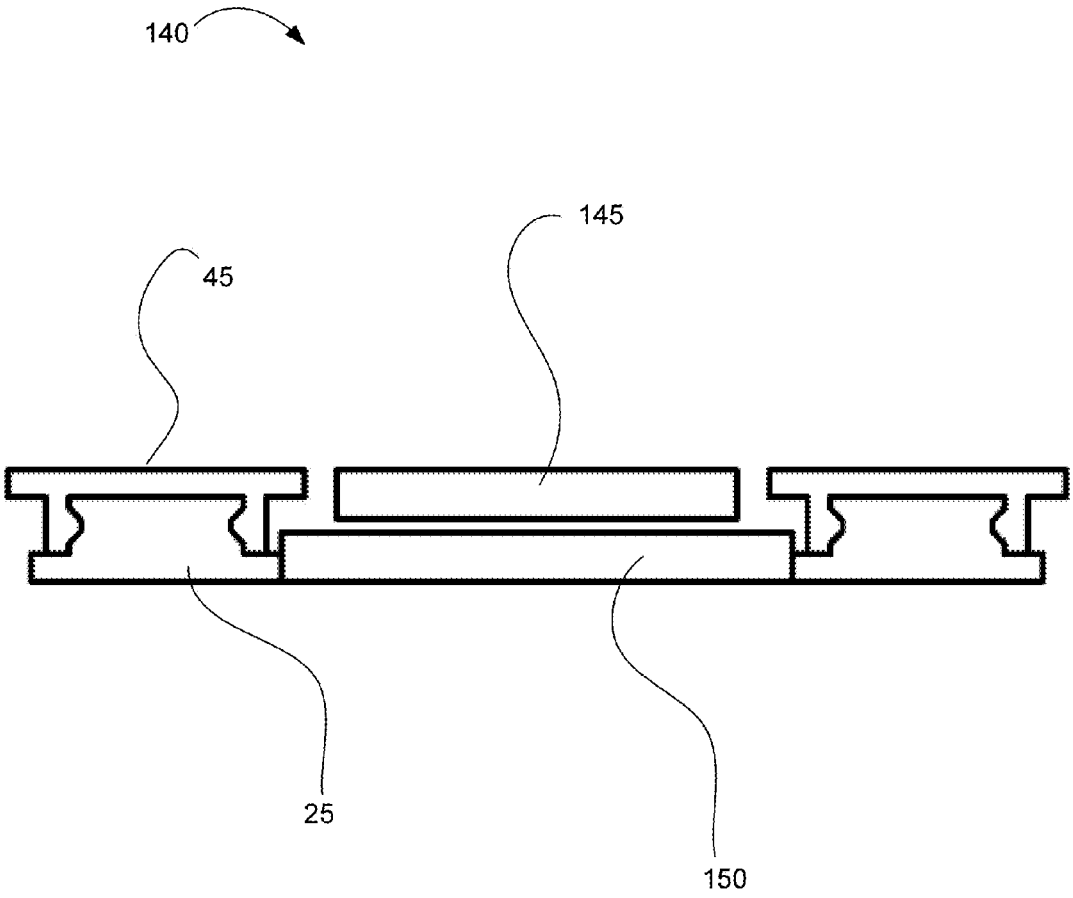
FIG. 11 is a plan view of a magnetic coil assembly.

In another variant, the jack has a second stage. Referring to FIGS. 10 and 11, a second inner jack member 160 has vertical walls configured to slide within the first inner jack member. The second inner jack member is nested within the first inner jack member and has at least two walls connected to respective inside faces of the vertical walls of the first inner jack member. A second linear magnetic drive assembly is provided on the second stage. The drive assembly comprises a magnetic coil and a magnet track. The magnet track is mounted on the first inner jack member and the magnetic coil mounted on the second inner jack member or vice versa. The magnetic track has a mechanical locking mechanism configured to prevent retraction of the drive assembly when the track reaches a predetermined extension. The magnetic drive assembly forms the connection between the first and second inner track members.

In a further variant, the telescopic jack has a plurality of stages, each comprising progressively smaller inner jack members connected to other jack members which encompass them, via a linear magnetic drive assembly.

In yet another variant, a jack assembly comprises an outside structure having structural sides and an inside structure having structural sides, the structures oriented in parallel and in close proximity wherein the outside and inside structures support slide assemblies. The slide assemblies comprise rails attached to the structures, a magnetic track and a coil. A movement system is associated with the slide assemblies. The movement system has attached rails and a coil.

In still a further variant, the jack assembly comprises a plurality of telescoping stages, each stage having rail and slide assemblies and a magnetic drive and coil. The jack assembly is adjustable to a desired height via the rail and slide assemblies and magnetic drive and coil at each stage. The telescopic jack is connectable to an overhead structure relative to the ground.

For example, FIGS. 6-9 illustrate a four stage jack assembly. Referring to FIGS. 6-9, the four stage jack assembly comprises first 125, second 160, third 200 and fourth 205 stages. Each stage has a magnetic coil assembly 12 comprising a linear motor 15 vertically mounted on a previous stage's frame's 20 side walls, and on a magnet track 40 and a coil 30 mounted to a second frame 35 positioned 0.038 mm or 0.015 inches apart from each other 25, 30. The magnetic track travels the length of the coil on THK slides 45 and rails 25 which is determined by the chosen stroke, based on the desired height of the jack in its extended configuration. The magnetic/coil assemblies 12 comprise the coil mounted to the inside of the structure and controlled by an electromagnetic pulse (Electric Controls) driving the magnetic track that is attached to the structure being lifted. The magnetic track 40 and slides 45 are combined into one ridged unit and the 15 magnetic track and rails are combined into another ridged unit which when assembled together provide the required gap between both units. The magnetic coil assemblies 12 can be located on each of the sides which are mounted to the base. In one example magnetic jack assembly, one slide assembly is provided with a magnetic attraction force (Magnetic to Coil) of 45,000 Newton's (10,125 pounds). For holding and positioning the desired height of the jack, a sealed absolute linear encoder may be provided on opposite sides of the frame 20.

The linear motor is a force producer, similar to a conventional rotary motor, and comprises wire coils and magnets. The motor coil is positioned over the magnets, and, as the current is fed through the motor coils, it interacts with the magnetic field and produces an electromotive force.

Linear motor coils are supported by the linear rails of the machine bed and the slide of the machine tool. The magnets may be placed on the jack frames. The coil may be placed on the inside of the frame adjacent the frame supporting the magnets In one embodiment, the motor coil is directly connected to a standard three-phase motor driver amplifier and slide position feedback is sent to the jack machine.

Linear motors can provide higher throughput, with little required maintenance. There are no drive components, such as ball screws or couplings, between the motor and the slide to introduce inaccuracies and wind-up errors. Accuracy is dependent only on the feedback device and the controller. Because each coil can be controlled independently from its own encoder, multiple slides can run on the same rails over the same magnetic track. The linear motor is not affected by travel. Unlike a ball screw, it has no critical rotational speed, making it ideal for long travel, high performance.

While various embodiments of the present invention have been described above, it should be understood that they have been presented by way of example only, and not of limitation Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A telescopic jack, comprising:

a base having vertical side walls having inside faces with a pair of parallel opposite faces;

a first inner jack member having vertical walls, configured to slide within the base, the first inner jack member being nested within the base and having at least two walls connected to respective inside faces of the vertical walls of the base; and a first linear magnetic drive assembly, comprising:

a magnetic coil;

a magnet track, the magnet track being mounted on the base and the magnetic coil mounted on the first inner jack member or vice versa;

wherein the magnetic drive assembly forms the connection between the base and the first inner track.

2. The telescopic jack of claim 1, comprising a plurality of stages, each comprising progressively smaller inner jack members connected to other jack members which encompass them, via respective linear magnetic drive assemblies.

3. The telescopic jack of claim 1, wherein the jack is connectable to an overhead structure relative to the ground.

4. The telescopic jack of claim 1, wherein the magnetic track has a mechanical locking mechanism configured to prevent retraction of the drive assembly when the track reaches a predetermined extension.

5. The telescopic jack of claim 1, further comprising:

a second inner jack member having vertical walls, configured to slide within the first inner jack member, the second inner jack member being nested within the first inner jack member and having at least two walls connected to respective inside faces of the vertical walls of the first inner jack member; and a second linear magnetic drive assembly, comprising:

a second magnetic coil;

a second magnet track, the second magnet track being mounted on the first inner jack member and the second magnetic coil mounted on the second inner jack member or vice versa;

wherein the second magnetic drive assembly forms the connection between the first and second inner track members.

6. The telescopic jack of claim 5, wherein the second magnetic track has a second mechanical locking mechanism configured to prevent retraction of the drive assembly when the second track reaches a predetermined extension.

7. The telescopic jack of claim 1, comprising slides and rails, the slides being mounted on the at least two walls first inner jack which are connected to the respective inside faces of the vertical walls of the base, and the rail being mounted on the respective inner faces of vertical walls of the base, or vice versa, each slide engaging a respective rail.

* * * * *